United States Patent [19]

Seyer et al.

[11] Patent Number: 4,549,737

[45] Date of Patent: Oct. 29, 1985

[54] POOL-TYPE MARBLE GAME

[76] Inventors: Jerome J. Seyer; Brenda J. Seyer, both of 419 Broadway, Cape Girardeau, Mo. 63701

[21] Appl. No.: 573,665

[22] Filed: Jan. 25, 1984

[51] Int. Cl.[4] ..... A63D 3/00

[52] U.S. Cl. ..... 273/118 R; 273/127 B; 273/3 B; 273/127 D

[58] Field of Search ..... 273/3 B, 118 D, 119 A, 273/119 R, 123 R, 127 B, 127 R, 353, 118 R, 127 D

[56] References Cited

U.S. PATENT DOCUMENTS

| | | | |
|---|---|---|---|
| 322,416 | 7/1885 | Burkel | 273/118 D |
| 445,626 | 2/1891 | Cogswell | 273/3 B |
| 675,273 | 5/1901 | Fuller | 273/123 R |
| 895,786 | 8/1908 | Perkins | 273/3 B |
| 954,628 | 4/1910 | Heath | 273/123 R |
| 1,943,697 | 7/1932 | Schultz | 273/123 R |
| 2,506,867 | 5/1950 | Gilliam | 273/123 R |
| 3,100,643 | 7/1961 | Almashy | 273/119 R |
| 3,203,699 | 9/1965 | Pearson | 273/123 R |

OTHER PUBLICATIONS

Diagram Group, *The Way to Play,* p. 125, 1975.

*Primary Examiner*—Richard C. Pinkham
*Assistant Examiner*—Benjamin Layno
*Attorney, Agent, or Firm*—Shoemaker and Mattare, Ltd.

[57] ABSTRACT

A pool-type marble game having a round rotatable game board, a pivotable and rotatable support structure including a central hub having five legs extending radially therefrom for supporting said game board from either a table top or another type support surface, a central scoring marble containing area, a shooting line larger than said marble area and surrounding same, a vertical rim around the periphery of the game board spaced therefrom to provide a marble collection recess or slot therearound, and appropriate scoring indicia or numbers adjacent the collection recess or slot. Another embodiment of the invention incorporates a hydraulic lift for the rotatable support mechanism, as well as a sloping ball return alleyway to lead the expended scoring marbles back to a common collection point. In addition, a coin operated collection box may be incorporated so that the game device can be used in game arcades and the like.

14 Claims, 8 Drawing Figures

POOL-TYPE MARBLE GAME

BACKGROUND OF THE INVENTION

1. Field of the Invention

This invention relates generally to devices for playing games of the marble type, and especially a game along the lines of the game of pool.

2. Description of the Prior Art

A common problem in known devices for playing marble-type games is that they often are unduly complicated, and require numerous rules, and sometimes complicated rules, for playing same. Also, known pool-type marble games oftentimes have complicated playing boards and related structure which increases the manufacturing costs thereof, thus putting the games out of the reach of the masses.

Another problem in known marble games is that they are not adaptable to coin operation in addition to being playable at home. A multi-purpose game usable for both home entertainment as well as arcade-type playing is highly desirable.

Existing prior art patents which may be pertinent to the present invention are as follows:

| | | |
|---|---|---|
| C. W. Fuller | 675,273 | 5/28/01 |
| F. G. Perkins | 895,786 | 8/11/08 |
| E. Schultz | 1,943,697 | 7/30/32 |
| F. O. Gilliam, Jr., et al. | 2,506,867 | 10/21/45 |
| G. Almashy | 3,100,643 | 7/28/61 |

These patents in general show marble-type games.

For example, Fuller U.S. Pat. No. 675,273 discloses a game board which is mounted for rotation on a pedestal and has ball receiving pockets 4 arranged around the rim of the game board. However, wickets 8 are interspersed in the center of the game board, and the playing operation is entirely different from that of the present invention.

U.S. Pat. No. 895,786 to Perkins shows a very elaborate pool-type game board. The overall structure is quite complicated and much more detailed than that of the present invention.

Schultz U.S. Pat. No. 1,943,697 shows a game board of elongated configuration and design for playing from one end to the other, as best depicted in FIG. 1 of the drawings. This game board quite clearly cannot be rotated in the manner of the present invention.

Gilliam, Jr., et al. U.S. Pat. No. 2,506,867 shows a very simple type marble game board having a depressed recess around the periphery of the board. However, no scoring indicia or related structure is provided with this device.

U.S. Pat. No. 3,100,643 to Almashy shows a marble-type device for providing an educational game. A plurality of scoring holes together with scoring indices are provided over the entire area of the game board. This structure is fairly complicated and requires rather complex counting and scoring operations.

None of the above-disclosed prior art patents, nor any other known prior art devices, offer the new and novel features of the present invention.

SUMMARY OF THE INVENTION

An object of the present invention is to provide a pool-type marble game which is playable both for home entertainment as well as in arcade-type playing situations.

Another object of the present invention is to provide a rotatable game board having a plurality of numbered marbles and at least one shooter marble, and provided with scoring indicia around the periphery of the rotatable game board.

A further object of this invention is to provide a marble game board playable in a manner along the lines of the game of pool which can be easily played by a number of players and which has structure provided around the periphery of the game board for enabling the scoring of points as well as collecting the marbles and returning same to a common collection point.

The present invention has a number of new and novel features. Among them is the provision for a family game that can be played by persons of all ages. A game board comprises a revolving table which can be turned so that each player in turn can shoot from his position. Scoring marbles are numbered pool fashion from 1 to 15, and at least one unnumbered shooter marble, preferably at least four of same, are provided for shooting and/or hitting the numbered marbles to deflect them into a desired scoring position.

Initially, when beginning a new game, all of the numbered marbles are placed within a small inner circle as inscribed in the inner area of the game board. Any conventional means can be used for selecting the order of players. A larger outer circle co-axially with the inner circle defines a shooting line behind which each player must stay in order for any points scored to count. Each time a shooter marble causes one of the numbered marbles to move into a marked or unmarked scoring slot around the periphery of the game board, a suitable count, either addition or substraction, is made. When no more numbered marbles are left in either of the inscribed circles on the game board, the game is over.

The game board of the family-type home entertainment construction comprises a circular game board of approximately 4 ft. diameter. Inner and outer circles are inscribed on the upper surface of the game board and form the areas for holding the numbered scoring marbles in the inner circle and the outer circle forming a shooting line behind which each player must remain for his points to count. Around the periphery of the game board is provided vertical flange structure for containing marbles on and within the game board surface. Between the lower portion of the flange and the game board itself is provided a circumferential recess or slot for receiving the marbles which have been ejected from the inner circle areas by a shooter marble. In the most simple embodiment, scoring indicia is appropriately provided at selected points around the game board. Depending on the indicia marked, the points are either added or subtracted from the value of the marbles shot thereinto and/or the total score of the individual player.

Another embodiment of the present invention adds structure for returning an expended marble to a common collection point. This version can also be easily adapted for coin operation and, therefore, can be used in gamerooms and other arcade-type playing situations. In this embodiment a hydraulic lift is employed so that the height of the game board revolving table can be controlled and varied to suit the players.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
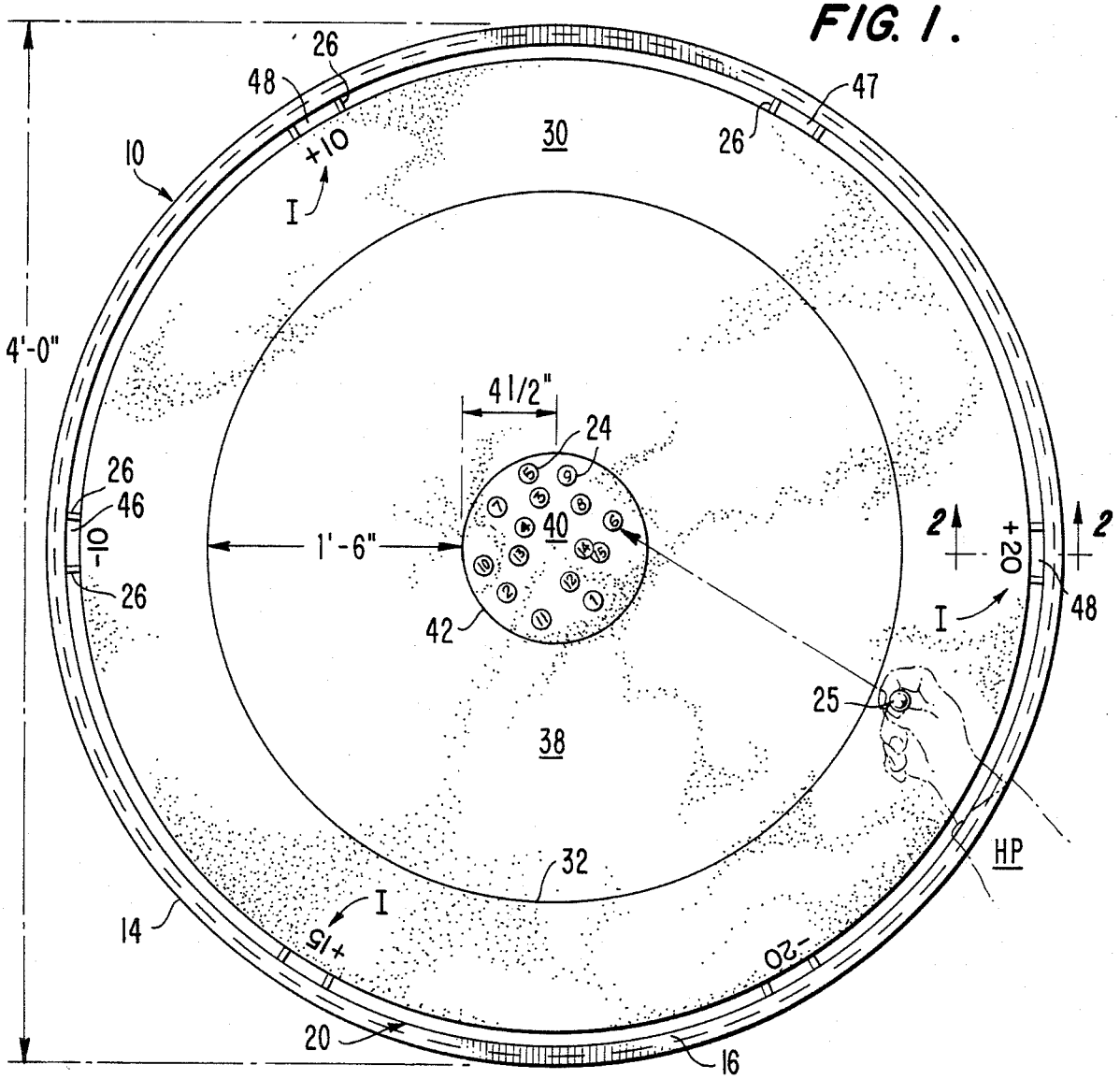
FIG. 1 is a top plan view of the family game version of the present invention.
Figure 2:
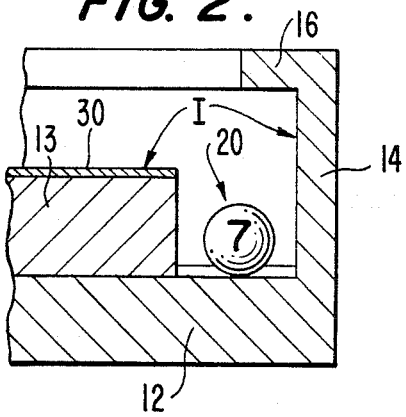
FIG. 2 is a fragmentary portion in cross section taken generally along line 2—2 of FIG. 1.
Figure 3:
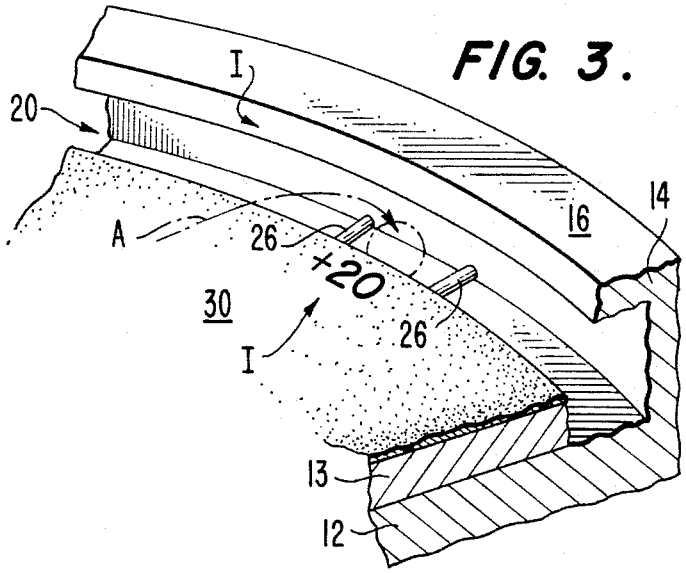
FIG. 3 is a fragmentary perspective of the cross sectional portion of FIG. 2.

Referring to FIG. 1 of the drawing, reference numeral 10 indicates in general the present invention. The device of the present invention has a base 12 and a sub-base 13 of suitable laminated material (as best seen in FIGS. 2 and 3). The base 12 is provided with an annular flange 14 which extends vertically around the circumference of the game board base. A rim 16 is provided along the upper portion of rim flange 14 and extends inwardly a short distance. Thus, a slot or recess 20 is provided between the circumference of the sub-base 13 and the inner surface of the flange rim 14, as best seen in FIG. 3. The upper surface of the sub-base 13 is provided with suitable felt 30 for forming a smooth marble rolling surface similar to that of a pool table surface.

As best seen in FIG. 1, an inner circle indicia line 42 provides an inner marble containing area 40. Normally at the beginning of a game, numbered marbles 24 are placed within the inner circle 42. These marbles preferably are numbered from 1 to 15 and total that number, i.e., fifteen marbles. A larger circle 38 is depicted by indicia line 32 which comprises the "no-man's land" area of the game board. During playing operation, a shooting marble 25 is appropriately held by a player (see phantom showing HP in FIG. 1) and used for bumping or hitting one of the scoring marbles 24. A player must shoot from outside of shooting line 32 in order for any points scored thereby to count.

Within the recess 20 are provided separator ridges 26 to provide the scoring areas I as indicated. Appropriate indicia or scoring numbers I are provided, as shown. The reference character 46 defines a negative number, reference character 47 indicates an area of "no score", while the reference 48 indicates an area of a plus scoring number.

After all of the numbered marbles 24 have been shot into the scoring areas, and/or the unmarked areas of recess 20, the game is over.

Figure 4:
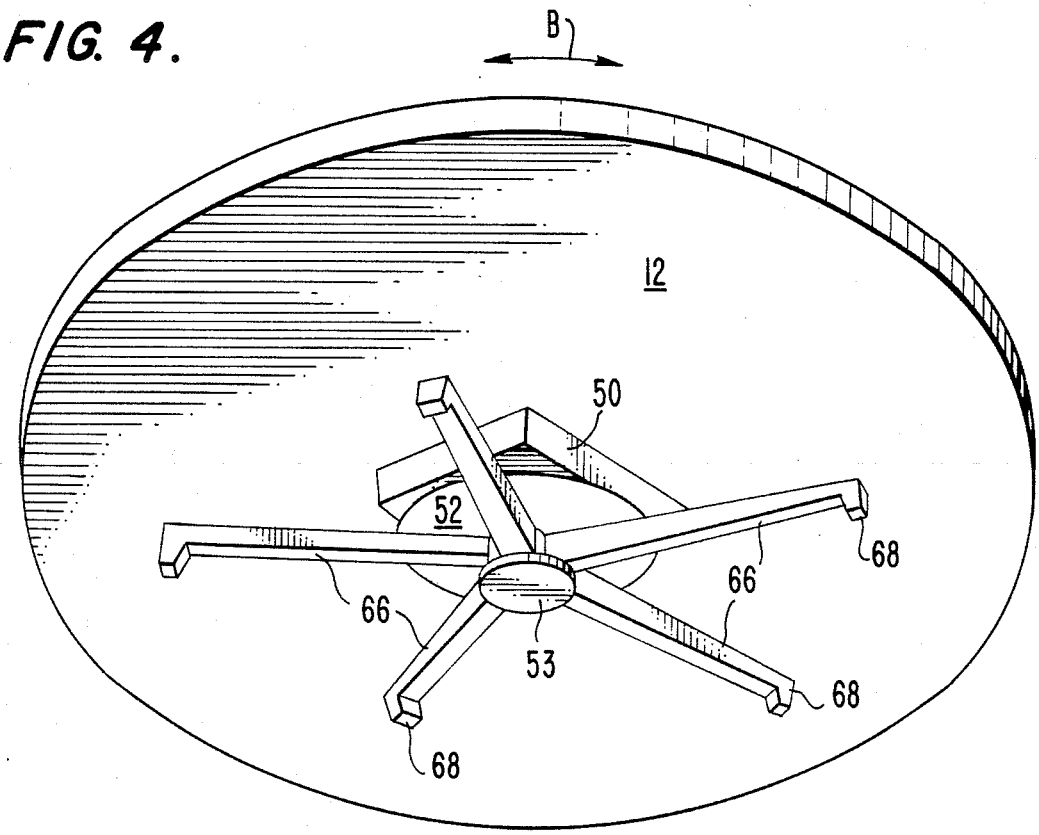
FIG. 4 is a perspective view from below showing the table top support structure of the embodiment of FIGS. 1–3.

FIG. 4 shows the structure for supporting the aforedescribed game board on the top of a table or other elevated support surface. Beneath the central area of game board 12 is mounted a rectangular or square support block 50 having a circular support structures 52 attached thereto. The circular structure 52 preferably contains suitable bearing structure for freely rotatably supporting the game board 12 from the leg cylinder hub 53. A plurality of five legs 66 are supported from cylinder hub 53. Each leg 66 has a suitable support tip 68 at the extreme end thereof. The use of five legs is very important as this arrangement provides for a very stable and firm supporting structure for the revolving game board table 12. As indicated by the double arrow B, the game board can be rotated easily in either direction.

While basically the above-described game can be played in a number of different ways, the recommended manner is as follows.

When starting the game, all of the numbered marbles are placed within the small inner circle 42 inscribed around the central axis of the game board, and any conventional means is used for selecting the starting player, who may turn the table to a desired position. A larger concentric circle 32 defines the shooting line behind which each player must stay in order for points scored to count, unless the player scores a point and his shooter marble stays within the large circle, in which case the player may shoot as many times as he continues to make points and his shooter marble stays within the large circle.

When a player shoots and a numbered marble lands in an unmarked slot, the player's score equals the number which is on that particular marble. Extra points are scored when a numbered marble lands in an extra point slot. For example, if a player shoots and causes the number 15 marble to in a plus 4 points slot, the total of his score will be 19 points. On the other hand, if the number 15 marble lands in a minus 4 points slot, the player's score will be 11. Points are scored only if a numbered marble remains in a plus point, minus point or unnumbered slot. If a numbered marble fails to stay in any slot, the player receives no points, and the marble must be returned to the inner small circle, at which time it is the next player's turn. The game continues in this manner until there are no numbered marbles remaining in either the small or large circles, at which time the layers total their points, the player with the highest score winning the game.

It is noted that to play this game, the shooter marble is held between the player's thumb and middle finger, with his knuckles resting on the table surface.

The second embodiment of the present invention is depicted in FIGS. 5–8 of the drawings. In this embodiment an elevated pedestal is used instead of the table top support already shown and described in FIG. 4. All of the components of the second embodiment which correspond to those of the first embodiment are labelled with the same reference numeral with a prime added thereto.

Figure 6:
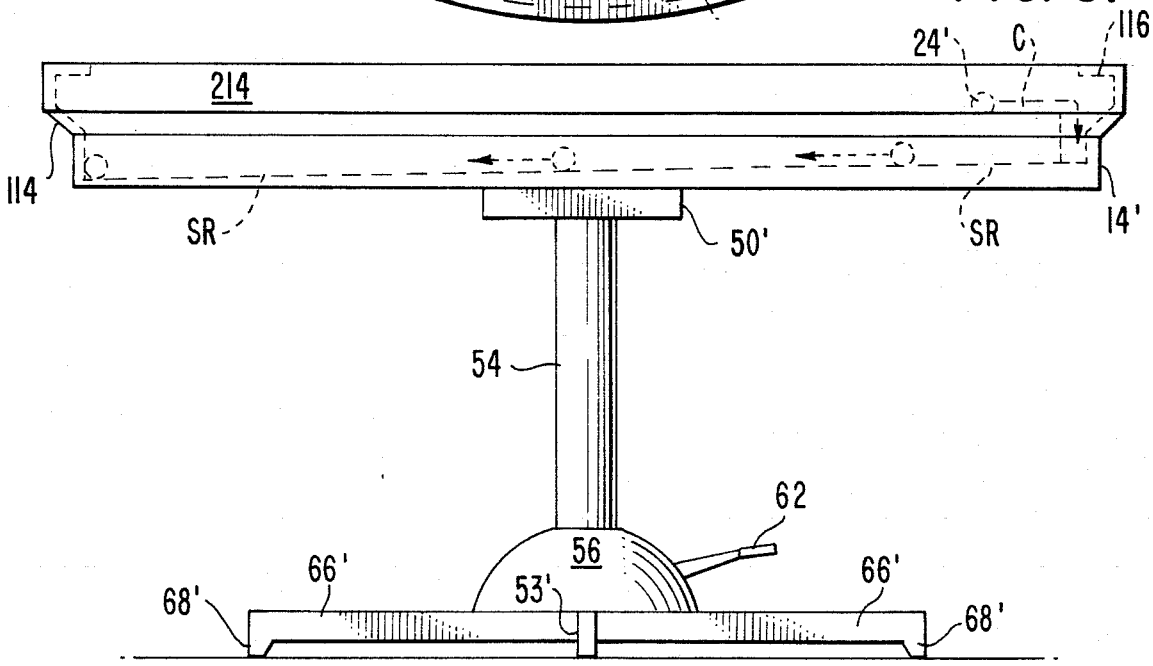
FIG. 6 is a side elevational view showing the floor mounting support structure of this second embodiment.

The support rectangular/square 50' is mounted on top of a pedestal 54 projecting from a hydraulic elevational structure 56. A hydraulic jack control lever 62 appropriately extends externally of this housing for easy actuation by a foot of an operator of the device. Support legs 66' with end tips 68', again preferably comprising five legs, are also shown in FIG. 6.

Figure 7:
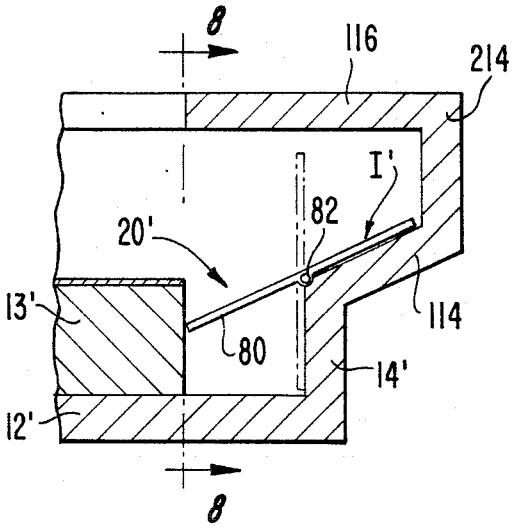
FIG. 7 is a fragmentary cross sectional view taken along line 7—7 of FIG. 5.
Figure 8:
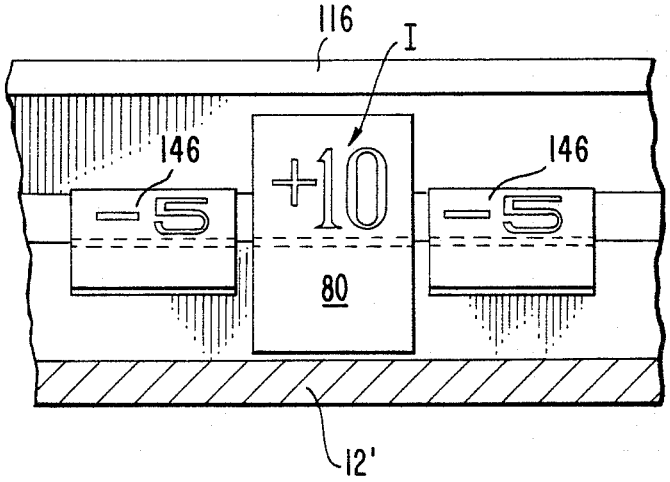
FIG. 8 is a fragmentary cross sectional view taken along line 8—8 of FIG. 7 showing the scoring marker and indicia associated therewith.

As best depicted in FIGS. 7 and 8, the scoring of this embodiment is accomplished by using pivotably mounted indicator structures 80 having suitable scoring indicia I' inscribed or printed thereon. Also, additional indicia 146 for the minus indicia are provided on either side of the primary indicator 80. A recess or slot 20' is also provided between the extreme outer circumference of sub-base 13' and the inner surface of the flange rim 14' extending integrally with the outer circumference of the base 12'. An appropriate pivot pin 82 is provided with indicator 80 for suitably pivotally mounting the ends thereof on the corner joint between rim 14' and sloping connector portion 114. The sloping connector portion 114 connects with vertical rim 214 which completes the outer flange rim of this second embodiment. A larger inwardly extending rim 116 is connected to the upper edge of the flange rim 214, as best seen in FIG. 7.

Obviously, when the scoring marbles are projected into the scoring areas of this second embodiment, the indicators 80 will be flipped upwardly as shown in the dotted line position of FIG. 7 so that the score can be easily seen and counted. The game itself is played in much the same manner as already described, the primary differences being that a hydraulic lift is used to adjust the height of the game board and the point indicator will be actuated due to the weight of a marble impinging on same for indicating the scored points. After the game is over, each of the pivotal point indicators 80 must be put back in the undeflected position manually.

Figure 5:
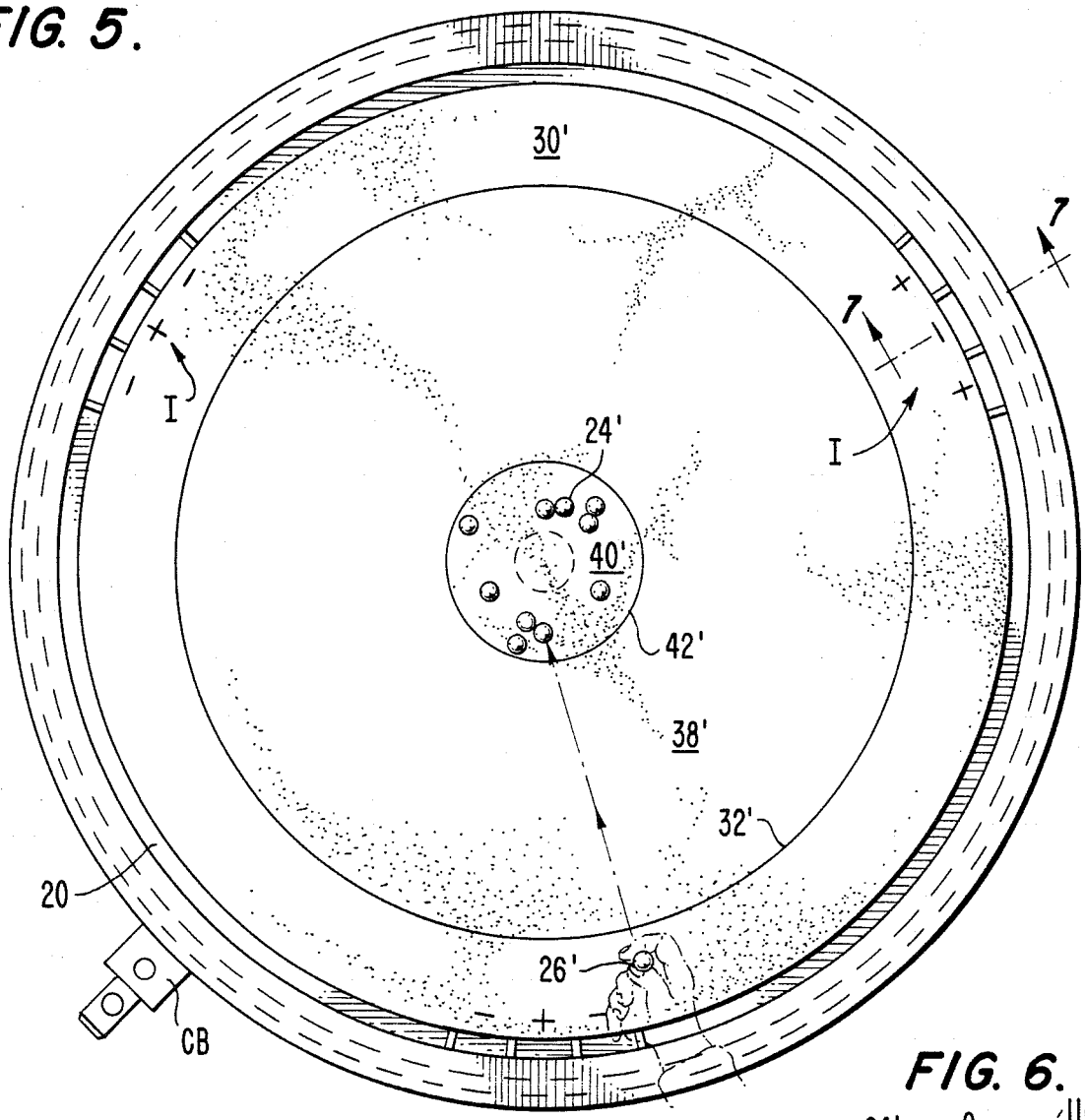
FIG. 5 is a top plan view of a second embodiment of the present invention.

Another important feature of the second embodiment is that an alleyway is provided around the game board for returning the use scoring marbles to a main collection point or coin box CB, as shown in FIG. 5. By returning the spent marbles to a common collection point, it is very easy to adapt the present invention to coin operation. A sloping return alley SR is indicated in the side elevational view of FIG. 6, which shows that the balls dropping at the diametrically opposite area to the coin box are at a slightly greater height than at the coin box itself. This slope of the alleyway effects the return by gravity of all balls which fall into the slot 20' surrounding the game board sub-base 13'.

The present invention, in either version, offers a very playable and interesting marble game.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

We claim:

1. A game device comprising:

a round game board;

means for supporting said round game board for rotation by a player during a game;

means for indicating shooting boundaries on a top surface of said game board;

a plurality of marbles having scoring numbers thereon;

at least one shooting marble for use by a game player;

scoring indicia means around the periphery of said round game board;

said means for supporting said round game board for rotation by a player during a game comprising a rotatable bearing mount, said rotatable bearing mount provided with a hub having a plurality of legs extending radially and horizontally therefrom;

said means for indicating shooting boundaries on a top surface of said game board including at least two concentric circles inscribed on said top surface, one circle being of relatively small inner diameter, and the other circle of a fairly large outer diameter;

said scoring indicia means on the periphery of the game board including a recess extending completely around the perimeter of the game board, said recess having scoring means associated closely adjacent thereto for indicating what score a player achieves during playing the game; and said scoring indicia means including a vertical outer flange rim with an overhang surrounding said game board.

2. The game device of claim 1, wherein each of said plurality of legs has an outer end support tip thereon, and a total of five legs are provided for maximum stability.

3. The game device of claim 1, wherein said small inner circle is provided for the plurality of numbered marbles, which total fifteen and have indicia indicating same thereon.

4. The game device of claim 3, wherein said outer circle provides a shooting line which each player must stay outside of during the playing of the game in order for his score to count, and four shooter marbles are provided for up to four players.

5. The game device of claim 1, wherein said scoring indicia means includes scoring numbers on the outer flange rim surface of said rotatable game board.

6. The game device of claim 5, wherein said scoring means further includes shallow ridges in the recess on the respective sides of each of said scoring numbers.

7. The game device of claim 1, wherein said scoring indicia means further includes pivotably mounted primary scoring indicators, each indicator having scoring numbers directly thereon.

8. The game device of claim 7, wherein said scoring indicia includes additional scoring indicators on either side of each respective primary scoring indicator.

9. The game device of claim 7, further including a marble return means for returning expended marbles after scoring to a marble retrieving collection box.

10. The game device of claim 9, wherein said marble retrieving collection box also includes a coin operated device for preventing the use of said return marbles until an appropriate number of coins have been inserted thereinto.

11. A pool-like marble game device comprising a rotatable round game board, bearing means for supporting said round game board for easy player rotation on a support surface, a central circular area on said game board for containing numbered scoring marbles therewithin, a plurality of numbered scoring marbles, a larger concentric circular shooting line indicated around the scoring marble area, a recess extending completely around the perimeter of the game board, a vertical rim having a top flange partially overhanging said recess and extending around the periphery of said round game board to provide a marble receiving slot circumferentially around the outer edge of said game board, and scoring means associated with said slot and vertical rim for indicating a scoring number.

12. The pool-like marble game device of claim 11, wherein said scoring means includes a pair of scoring retaining ridges of relatively small height adjacent a numbered scoring area of said slot.

13. The pool-like marble game device of claim 11, wherein said scoring means includes a pivotably mounted primary indicator having suitable scoring indicia thereon for deflection under the weight of a marble when hit thereby.

14. The pool-like marble game device of claim 13, wherein said scoring indicia includes additional scoring indicators on either side of each respective primary scoring indicator.

* * * * *